US008480880B2

(12) United States Patent
Miller

(10) Patent No.: US 8,480,880 B2
(45) Date of Patent: Jul. 9, 2013

(54) PROCESS FOR MAKING HIGH VISCOSITY INDEX LUBRICATING BASE OILS

(75) Inventor: Stephen J. Miller, San Francisco, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 261 days.

(21) Appl. No.: 13/008,153

(22) Filed: Jan. 18, 2011

(65) Prior Publication Data

US 2012/0184787 A1 Jul. 19, 2012

(51) Int. Cl.

| | |
|---|---|
| ***C10G 71/00*** | (2006.01) |
| ***C10G 73/38*** | (2006.01) |
| ***C10G 73/44*** | (2006.01) |
| ***C10M 169/04*** | (2006.01) |
| ***C10M 171/02*** | (2006.01) |

(52) U.S. Cl.
USPC ..... 208/19; 208/18; 208/24; 208/46; 208/62

(58) Field of Classification Search
USPC ..... 208/18, 19, 24, 46, 62
See application file for complete search history.

(56) References Cited

U.S. PATENT DOCUMENTS

| | | | | |
|---|---|---|---|---|
| 3,365,386 | A | 1/1968 | Van Pool | |
| 3,845,157 | A | 10/1974 | Woo | |
| 3,852,207 | A | 12/1974 | Stangeland et al. | |
| 4,617,092 | A | 10/1986 | Hiramatsu | |
| 4,622,129 | A * | 11/1986 | Bayle et al. | 208/87 |
| 4,642,401 | A | 2/1987 | Coenen et al. | |
| 4,673,487 | A | 6/1987 | Miller | |
| 4,894,145 | A | 1/1990 | Jensen | |
| 5,135,638 | A | 8/1992 | Miller | |
| 5,282,958 | A | 2/1994 | Santilli et al. | |
| 5,849,964 | A | 12/1998 | Holighaus et al. | |
| 6,143,940 | A | 11/2000 | Miller et al. | |
| 6,150,577 | A | 11/2000 | Miller et al. | |
| 6,703,353 | B1 * | 3/2004 | Lok et al. | 508/110 |
| 6,774,272 | B2 | 8/2004 | Miller | |
| 6,822,126 | B2 | 11/2004 | Miller | |
| 7,282,134 | B2 | 10/2007 | Abernathy et al. | |
| 7,473,345 | B2 | 1/2009 | Rosenbaum et al. | |
| 2009/0062168 | A1 | 3/2009 | Timar et al. | |
| 2009/0170739 | A1 | 7/2009 | Miller | |

FOREIGN PATENT DOCUMENTS

EP 0620264 A2 10/1994

OTHER PUBLICATIONS

PCT International Search Report, PCT/US2012/021171, mailed Aug. 31, 2012.

S.J. Miller, N. Shah, and G.P. Huffman, "Converion of Waste Plastic to Lubricating Base Oil," Energy & Fuels, 19, 1580-1586 (2005).

* cited by examiner

*Primary Examiner* — Walter D Griffin
*Assistant Examiner* — Derek Mueller
(74) *Attorney, Agent, or Firm* — Terrence Flaherty; E. Joseph Gess

(57) ABSTRACT

A process for making a lubricating base oil having a viscosity index of at least 110, comprising the steps of: combining a waxy light neutral base oil and a wax derived from pyrolyzing a plastics feed comprising polyethylene to form a blend; hydroisomerization dewaxing the blend; and recovering the lubricating base oil from an effluent from the hydroisomerization dewaxing step.

17 Claims, No Drawings

PROCESS FOR MAKING HIGH VISCOSITY INDEX LUBRICATING BASE OILS

TECHNICAL FIELD

The present invention relates to a process for making Group II plus/Group III lubricating base oils from blends of a waxy light neutral base oil and a wax derived from pyrolyzing a plastics feed.

BACKGROUND

Because of environmental concerns, automobile manufacturers and government regulators have introduced new, more stringent performance requirements for lubricants. As a result, the specifications for finished lubricants are requiring products having excellent low temperature properties, high oxidation stability, and low volatility. Currently, only a small fraction of the base oils manufactured today are able to meet these demanding specifications.

Group II plus base oil, though not an official American Petroleum Institute (API) designation, is a term used to describe API Group II stocks of higher viscosity index (110-119) and lower volatility than comparable Group II stocks.

Due to their low viscosity and low volatility, API Group III base oils have become the base stocks of choice for the next generation of lubricant compositions. This in turn has lead to a greater demand for Group III base oils. However, producing Group III base oils can be difficult requiring the use of special high viscosity index gas oils which can be higher in cost than gas oils used to make Group II base oils. In addition, the production of Group III base oils can also involve hydrocracking gas oils at higher severity in order to get the viscosity index to at least 120 which may result in lower yield, downgrading potential base oil to lower valued diesel and other light products, and shortening the hydrocracker catalyst life.

It would be advantageous if a refiner could simply switch from Group II base oil production to Group II plus or Group III base oil production by adding a minor amount of a different second feed to the hydrocracked Group II base oil ahead of an isomerization dewaxing unit in order to boost the viscosity index for as long as the Group II plus or Group III base oil production was required. It would also be advantageous if the second feed were low in cost and had additional benefits, such as reduction of environmental waste.

One potential low cost feed is waste plastics. According to a 2009 report from the U.S. Environmental Protection Agency Office of Resource Conservation and Recovery, about 52% of all plastic packaging in the United States is composed of polyethylene, the preferred feed for plastics conversion to lubricating oils. Polyethylene plastic is found in two main forms: high-density polyethylene (HDPE), which is used for making rigid containers such as bottles, and low-density polyethylene (LDPE), which is used for making flexible films such as grocery bags. Plastics waste is a fast growing waste product, with about 30 million tons per year generated in 2008 compared to about 18 million tons per year generated in 1995. Transforming waste plastic material and particularly polyethylene into useful products presents a unique opportunity to address a growing environmental problem.

Accordingly, it would be desirable to devise an economical process which converts hydrocracked oils blended with a wax derived from pyrolyzing a plastics feed into Group II plus or Group III base oils.

SUMMARY OF THE INVENTION

In one aspect, the invention relates to a process for making a lubricating base oil having a viscosity index of at least 110, comprising the steps of: combining a waxy light neutral base oil and a wax derived from pyrolyzing a plastics feed comprising polyethylene to form a blend; hydroisomerization dewaxing the blend; and recovering the lubricating base oil from an effluent from the hydroisomerization dewaxing step.

DETAILED DESCRIPTION

The following terms will be used throughout the specification and will have the following meanings unless otherwise indicated.

"Waxy light neutral base oil" refers to a base oil having a boiling range of approximately 650° F. to 900° F. (343° C. to 482° C.) and a pour point of at least 20° C.

"Boiling range" refers to the 5 wt. % boiling point to the 95 wt. % boiling point, inclusive of the end points, as measured by ASTM D6352-04 (reapproved 2009) and referred to herein as Simulated Distillation. For example, a hydrocarbon with a boiling range of 700° F. to 900° F. has a 5 wt. % boiling point greater than 700° F. and a 95 wt. % boiling point less than 900° F.

The terms "waste plastics" or "waste polyethylene" refer to plastics or polyethylene that have been subject to use and are considered garbage, refuse, or material for recycling.

The terms "virgin plastics" or "virgin polyethylene" refer to plastics or polyethylene that are fresh and/or newly made and have not been subject to use.

"Group II base oil" refers to a base oil which contains greater than or equal to 90% saturates and less than or equal to 0.03% sulfur and has a viscosity index greater than or equal to 80 and less than 120 using the ASTM methods specified in Table E-1 of American Petroleum Institute Publication 1509.

"Group II plus base oil" refers to a Group II base oil having a viscosity index greater than or equal to 110 and less than 120.

"Group III base oil" refers to a base oil which contains greater than or equal to 90% saturates and less than or equal to 0.03% sulfur and has a viscosity index greater than or equal to 120 using the ASTM methods specified in Table E-1 of American Petroleum Institute Publication 1509.

"Viscosity index" refers to an empirical, unit-less number indicating the effect of temperature change on the kinematic viscosity of petroleum products, such as lubricating base oils. The higher the viscosity index of an oil, the lower its tendency to change viscosity with temperature. The viscosity index can be determined by ASTM D2270-10.

"Pour point" refers to the temperature at which a hydrocarbon fraction (e.g., a lubricating base oil) will begin to flow under certain carefully controlled conditions. In this disclosure, where pour point is given, unless stated otherwise, it has been determined by ASTM D5950-02 (reapproved 2007) or an equivalent analytical method.

"Cloud point" refers the temperature at which a hydrocarbon fraction (e.g., a lubricating base oil) begins to develop a haze under carefully controlled conditions. In this disclosure, where cloud point is given, unless otherwise stated, it has been determined by ASTM D5773-10 or an equivalent analytical method.

"Periodic Table" refers to the version of the IUPAC Periodic Table of the Elements dated Jun. 22, 2007, and the numbering scheme for the Periodic Table Groups is as described in *Chem. Eng. News,* 63(5), 26-27 (1985).

Waxy Light Neutral Base Oil

Petroleum refiners often produce desirable products such as lube base stock by hydrocracking a hydrocarbon feedstock derived from crude oil, for example. Feedstocks most often subjected to hydrocracking for lube base stock production are gas oils and heavy gas oils recovered from crude oil by distillation. A typical gas oil comprises a substantial portion of hydrocarbon components, usually about 50% or more by weight, boiling above 720° F. (382° C.). An exemplary boiling point range for a vacuum gas oil is typically from 600° F. to 1050° F. (316° C. to 566° C.).

Hydrocracking is generally accomplished by contacting, in a hydrocracking reactor or reaction zone, the gas oil or other feedstock to be treated with a suitable hydrocracking catalyst under conditions of elevated temperature and pressure. Hydrocracking reactions reduce the overall molecular weight of the heavy hydrocarbon feedstock to yield upgraded (that is, higher value) products including blending components for transportation fuels such as diesel and gasoline. These upgraded products that are converted in the hydrocracking reaction zone are typically separated from the total hydrocracker effluent as lower boiling fractions, using one or more separation and/or distillation operations. A remaining higher boiling fraction, containing a waxy light neutral base oil, is always generated in the fractionators. A portion of the waxy light neutral base oil can be drawn to the outside for use as a feedstock for lubricating base oil while the remaining waxy light neutral base oil can be recycled back to the hydrocracking unit.

While this recycled material contains predominantly higher molecular weight hydrocarbons, the waxy light neutral base oil is normally still considered to have improved quality compared to the fresh heavy hydrocarbon feedstock, due to other reactions in the hydrocracking zone. In particular, most of the heteroatom contaminants, such as sulfur and nitrogen compounds, are removed; aromatic compounds are hydrogenated to their corresponding saturated cyclic compounds; and viscosity is reduced. As a result, the waxy light neutral base oil is stabilized and generally has properties that are favorable for lubricant base oils.

The operating conditions in the hydrocracking zone are those typical of commercial hydrocracking operations. The temperature in the hydrocracking zone will be within the range of from 500° F. to 896° F. (260° C. to 480° C.), such as within the range of from 653° F. to 797° F. (345° C. to 425° C.). A total pressure above 1000 psig (6.89 MPa) is used. For example, the total pressure can be above 1500 psig (10.34 MPa), or above 2000 psig (13.79 MPa). Although greater maximum pressures have been reported in the literature and may be operable, the maximum practical total pressure generally will not exceed 3000 psig (20.68 MPa). The liquid hourly space velocity (LHSV) will usually fall within the range of from 0.2 to 5 $h^{-1}$, typically from 0.5 to 1.5 $h^{-1}$. The supply of hydrogen (both make-up and recycle) is preferably in excess of the stoichiometric amount needed to crack the target molecules and will usually fall within the range of from 0.5 to 20 MSCF/bbl (thousand standard cubic feet per barrel). In one embodiment, the hydrogen will be within the range from 2 to 10 MSCF/bbl. Note that a feed rate of 10 MSCF/bbl is equivalent to 1781 L $H_2$/L feed.

The catalysts used in the hydrocracking zone are composed of natural and synthetic materials having hydrogenation and dehydrogenation activity. These catalysts are well known in the art and are pre-selected to crack the target molecules and produce the desired product slate. The hydrocracking catalyst is selected to convert a heavy hydrocarbon feedstock to a product slate containing a commercially significant amount of a waxy intermediate fraction which will be upgraded to the base oil. Exemplary commercial cracking catalysts generally contain a support consisting of alumina, silica, silica-alumina composites, silica-alumina-zirconia composites, silica-alumina-titania composites, acid treated clays, crystalline aluminosilicate zeolitic molecular sieves (e.g., zeolite A, faujasite, zeolite X, zeolite Y), and various combinations of the above. The hydrogenation/dehydrogenation components generally consist of a metal or metal compound of Group 6 or Groups 8 to 10 of the Periodic Table of the Elements. Metals and their compounds such as, for example, cobalt, nickel, molybdenum, tungsten, platinum, palladium and combinations thereof are known hydrogenation components of hydrocracking catalysts.

Lighter products can be removed from the hydrocracker effluent by distillation to provide a waxy light neutral base oil. Various different types of vacuum distillation control systems may be employed, such as those taught in U.S. Pat. Nos. 3,365,386; 4,617,092; or 4,894,145.

The waxy light neutral base oil has a pour point of at least 20° C.; generally, from 20° C. to 40° C.; typically from 20° C. to 30° C.; and often from 20° C. to 24° C.

Wax Derived from Pyrolyzing a Plastics Feed

The plastics feed can be selected from the group consisting of waste plastics, virgin plastics, and mixtures thereof. Use of waste plastics in the plastics feed reduces the cost of the process. However, it is not necessary to utilize waste plastics. As such, the plastics feed can be composed entirely of virgin plastics.

The plastics feed can also contain polyethylene. The plastics feed can comprise between 80 wt % and 100 wt. % polyethylene, for example, between 95 wt. % and 100 wt. % polyethylene. If the plastics feed contains polyethylene, the polyethylene can be selected from the group consisting of waste polyethylene, virgin polyethylene, and mixtures thereof. Furthermore, if the plastics feed contains polyethylene, the polyethylene can be selected from the group consisting of high-density polyethylene (HDPE), low-density polyethylene (LDPE), and mixtures thereof.

Typically, the plastics feed is ground to a suitable size for transport to a pyrolysis zone and then transported to the pyrolysis zone by any conventional means for feeding solids to a vessel. Optionally, the ground plastics feed can be heated and initially dissolved in a solvent. This heated material can then be passed by an auger, or other conventional means, to the pyrolysis zone. After the initial feed, a portion of the heated liquefied feed from the pyrolysis zone can be optionally removed and recycled to the feed to provide a heat source for dissolving the feed.

The plastics feed can contain some contaminants normally associated with waste plastics, e.g., paper labels and metal caps. The feed can also contain chlorine, for example, less than about 20 ppm. A substantial portion of any chlorine in the feed can be removed by adding a chlorine scavenger compound (e.g., sodium carbonate) to the feed. Such a chlorine scavenger compound reacts with chlorine in the pyrolysis zone to form sodium chloride, which becomes part of the residue at the bottom of the pyrolysis zone.

Pyrolysis conditions in the pyrolysis zone can include a temperature from 450° C. to 700° C., typically from 450° C. to 600° C. Generally, the plastics feed has a residence time in the pyrolysis zone between 3 minutes and 1 hour.

Conventional pyrolysis technology teaches operating conditions of above-atmospheric pressures. By adjusting the pressure downward, the yield of a desired product can be controlled. If a pyrolysis effluent of lighter wax is desired, the pressure in the pyrolysis zone should be about atmospheric, for example, from 0.75 atm to 1 atm. If a pyrolysis effluent of heavier wax is desired, the pressure in the pyrolysis zone can be sub-atmospheric, for example, not greater than 0.75 atm or not greater than 0.5 atm. Without wishing to be bound by any particular theory, it is believed that, when operating in batch pyrolysis mode with sub-atmospheric pressures in the pyrolysis zone, thermally cracked plastic goes overhead and out of the pyrolysis zone before secondary cracking can occur, resulting in a greater yield of heavier wax.

The pyrolysis zone pressure can be controlled by vacuum or by addition of an inert gas (that is, acts inert in the pyrolysis zone) selected from, for example, nitrogen, hydrogen, steam, methane or recycled light ends from the pyrolysis zone. The inert gas reduces the partial pressure of the plastic gaseous product. It is the partial pressure which is of interest in controlling the weight of the pyrolysis zone product.

The pyrolysis zone effluent typically contains a broad boiling point range of materials. The pyrolysis zone effluent (liquid portion) is very waxy and has a high pour point. It comprises n-paraffins and some olefins. The effluent stream can be fractionated by conventional means into typically at least three fractions, a light, middle, and heavy fraction. The light fraction (e.g., 350° F.–; 177° C.– boiling point) contains gasoline range material and gases. The middle fraction (e.g., 350° F. to 650° F.; 177° C. to 343° C. boiling point) is typically a middle distillate range material. The heavy fraction (e.g., 650° F.+; 343° C.+ boiling point) is a lubricating oil range material. All fractions contain n-paraffins and olefins.

Blends

The waxy light neutral base oil and the wax derived from pyrolyzing a plastics feed are blended by means well known in the art. Typical blends comprise a mixture of 90 to 10 wt. % of the waxy light neutral base oil and 10 to 90 wt. % of the wax derived from pyrolyzing a plastics feed, based on the total weight of the blend. In one embodiment, the blend comprises at least 20 wt. % of the wax derived from pyrolyzing a plastics feed; in second embodiment, at least 30 wt. % of the wax derived from pyrolyzing a plastics feed; in a third embodiment, at least 40 wt. % of the wax derived from pyrolyzing a plastics feed; in a fourth embodiment, at least 50 wt. % of the wax derived from pyrolyzing a plastics feed. Higher percentages in the blend of the wax derived from pyrolyzing a plastics feed can produce higher viscosity index base oils.

It is usually desirable to maintain as low a cloud point as possible for the blend. If the pyrolyzed plastics feed has too much wax boiling above 1000° F. (538° C.), then the blend has a high cloud point which is difficult to reduce without extra conversion in the hydroisomerization dewaxing step. In one embodiment, less than 10 wt. % of the wax derived from pyrolyzing a plastics feed boils above 1000° F. (538° C.); in another embodiment, less than 5 wt. % of the wax derived from pyrolyzing a plastics feed boils above 1000° F. (538° C.).

Hydroisomerization Dewaxing

The hydroisomerization dewaxing is achieved by contacting the blend with a hydroisomerization catalyst in an isomerization zone under hydroisomerizing conditions. The hydroisomerization catalyst generally comprises a shape selective intermediate pore size molecular sieve, a noble metal hydrogenation component, and a refractory oxide support. The shape selective intermediate pore size molecular sieve is typically selected from the group consisting of SAPO-11, SAPO-31, SAPO-41, SM-3, SM-7, ZSM-22, ZSM-23, ZSM-35, ZSM-48, ZSM-57, SSZ-32, SSZ-32X, metal modified SSZ-32X, offretite, ferrierite, and combinations thereof. SAPO-11, SM-3, SM-7, SSZ-32, ZSM-23, and combinations thereof are often used. The noble metal hydrogenation component can be platinum, palladium, or combinations thereof.

The hydroisomerizing conditions depend on the blend used, the hydroisomerization catalyst used, whether or not the catalyst is sulfided, the desired yield, and the desired properties of the lubricating base oil. Preferred hydroisomerizing conditions useful in the current invention include temperatures of 500° F. to 775° F. (260° C. to 413° C.), a total pressure of 15 to 3000 psig (0.10 to 20.68 MPa), a LHSV of 0.25 to 20 $h^{-1}$, and a hydrogen to feed ratio from 2 to 30 MSCF/bbl. In some embodiments, the hydrogen to feed ratio can be from 4 to 20 MSCF/bbl, in others from 4.5 to 10 MSCF/bbl, and in still others from 5 to 8 MSCF/bbl. Note that a feed rate of 10 MSCF/bbl is equivalent to 1781 L $H_2$/L feed. Generally, hydrogen will be separated from the product and recycled to the isomerization zone.

In some embodiments, the hydroisomerization dewaxing is conducted in a series of reactors for optimal yield and base oil properties. A series of hydroisomerization reactors with inter-reactor separation may achieve the same pour point reduction, at lower temperatures and lower catalyst aging rates, as a single reactor without product separation and recycle or multiple reactors without inter-reactor separation. Therefore, multiple reactors with inter-reactor separation may operate longer within the desired ranges of temperature, space velocity and catalyst activity than a single reactor or multiple reactors without inter-reactor separation.

Additional details of suitable hydroisomerization dewaxing processes are described in U.S. Pat. Nos. 5,135,638; 5,282,958; and 7,282,134.

Hydrofinishing

Optionally, the base oil produced by hydroisomerization dewaxing may be hydrofinished. The hydrofinishing may occur in one or more steps, either before or after fractionating of the base oil into one or more fractions. The hydrofinishing is intended to improve the oxidation stability, UV stability, and appearance of the product by removing aromatics, olefins, color bodies, and solvents. A general description of hydrofinishing may be found in U.S. Pat. Nos. 3,852,207 and 4,673,487. The hydrofinishing step may be needed to reduce the amount of olefins in the base oil to less than 10 wt. %, generally less than 5 or 2 wt. %, more typically less than 1 wt. %, even more typically less than 0.5 wt. %, and most often less than 0.05 or 0.01 wt. %. The hydrofinishing step may also be needed to reduce the amount of aromatics to less than 0.3 or 0.1 wt. %, generally less than 0.05 wt. %, more typically less than 0.02 wt. %, and often less than 0.01 wt. %. Generally, the hydrofinishing is conducted at a total pressure greater than 500 psig (3.45 MPa), more typically greater than 700 psig (4.83 MPa), and often greater than 850 psig (5.86 MPa). In some embodiments, the hydrofinishing may be conducted in a series of reactors to produce base oils with superior oxidation stability and low wt. % Noack volatility. As with hydroisomerization dewaxing, hydrofinishing in multiple reactors with inter-reactor separation may operate longer within the desired ranges of temperature, space velocity and catalyst activity than a single reactor or multiple reactors without inter-reactor separation.

Fractionating

Lubricating base oil is typically separated into fractions. The lubricating base oil, if broad boiling, may be fractionated into different viscosity grades of base oil. In the context of this disclosure, "different viscosity grades of base oil" is defined as two or more base oils differing in kinematic viscosity at 100° C. from each other by at least 1.0 cSt. Typically, fractionating is done using one or more vacuum distillation units to yield cuts with pre-selected boiling ranges.

In one embodiment, the lubricating base oil is a Group II plus base oil; in another embodiment, a Group III base oil.

In one embodiment, the lubricating base oil has a viscosity index of at least 130; in another embodiment, a viscosity index of at least 140.

In one embodiment, the lubricating base oil has a pour point of less than 0° C.; in another embodiment, a pour point of less than −10° C.; in yet another embodiment, a pour point of less than −20° C.

In one embodiment, the lubricating base oil has a cloud point of less than 0° C.

EXAMPLES

The following examples are given to illustrate the present invention. It should be understood, however, that the invention is not to be limited to the specific conditions or details described in these examples.

Example A

A hydrocracked waxy light neutral base oil was isomerized over a Pt/SSZ-32 catalyst, containing 35 wt. % CATAPAL® alumina binder in a continuous feed high pressure pilot plant with once-through hydrogen gas. Run conditions were 1.0 $h^{-1}$ LHSV, 575° F., 1935 psig total pressure, and 5.70 MSCF/bbl $H_2$. Downstream of the isomerization catalyst was a second reactor containing a Pd on silica-alumina hydrofinishing catalyst run at 1.0 $h^{-1}$ LHSV and 450° F. Inspections on the base oil feed are given in Table 1.

TABLE 1

| Waxy Light Neutral Base Oil | |
|---|---|
| Gravity (°API) | 34.1 |
| Pour point (° C.) | +24 |
| Simulated Distillation, (° F., LV %) | |
| IBP/5 | 575/640 |
| 10/30 | 669/720 |
| 50 | 751 |
| 70/90 | 782/821 |
| 95/EP | 839/876 |

Product yields and properties are given in Table 2. Conversion<700° F. is defined as: [(g 700° F.+ (feed)−g 700° F.+ (product))/g 700° F.+ (feed)]×100%.

TABLE 2

| Isomerization of Waxy Light Neutral Base Oil at 575° F., 1.0 $h^{-1}$ LHSV, 1935 psig, and 5.70 MSCF/bbl $H_2$ | |
|---|---|
| Conversion <700° F. (wt. %) | 7.64 |
| Yields (wt. %) | |
| $C_1$-$C_2$ | 0.08 |
| $C_3$ | 0.59 |
| $C_4$ | 0.63 |
| $C_5$-180° F. | 1.56 |
| 180-700° F. | 23.65 |
| 700° F.+ | 74.17 |
| Pour point (° C.) | −15 |
| Cloud point (° C.) | −2 |
| Viscosity, 40° C. (cSt) | 17.81 |
| Viscosity, 100° C. (cSt) | 3.844 |
| VI | 107 |

Example 1

To the feed of Example A was added 11 wt. % of a 650° F.+ wax derived from the pyrolysis of a waste polyethylene feedstock. The resulting feed had the inspections shown in Table 3.

TABLE 3

| Blend of Waxy Light Neutral Base Oil and 11 wt. % 650° F.+ Wax from Plastic Pyrolysis | |
|---|---|
| Gravity (°API) | 34.5 |
| Simulated Distillation, (° F., LV %) | |
| IBP/5 | 583/644 |
| 10/30 | 672/724 |
| 50 | 756 |
| 70/90 | 788/833 |
| 95/EP | 854/944 |

This feed was isomerized over the same catalyst as the feed in Example A at the same total pressure, LHSV, and $H_2$ rate, but an isomerization catalyst reactor temperature of 600° F. Hydrofinishing was the same as in Example A. Product yields and properties are given in Table 4.

TABLE 4

| Isomerization of Waxy Light Neutral Base Oil Plus 11 wt. % Wax from Plastic Pyrolysis at 600° F., 1.0 $h^{-1}$ LHSV, 1935 psig, and 5.70 MSCF/bbl $H_2$ | |
|---|---|
| Conversion <700° F. (wt. %) | 8.46 |
| Yields (wt. %) | |
| $C_1$-$C_2$ | 0.12 |
| $C_3$ | 0.40 |
| $C_4$ | 0.96 |
| $C_5$-180° F. | 2.27 |
| 180-700° F. | 21.55 |
| 700° F.+ | 75.10 |
| Pour point (° C.) | −18 |
| Cloud point (° C.) | +4 |
| Viscosity, 40° C. (cSt) | 19.60 |
| Viscosity, 100° C. (cSt) | 4.162 |
| VI | 115 |

Example 2

To the feed of Example A was added 21.3 wt. % of a 650° F.+ wax derived from the pyrolysis of a waste polyethylene feedstock. The resulting feed had the inspections shown in Table 5.

TABLE 5

| Blend of Waxy Light Neutral Base Oil and 21.3 wt. % 650° F.+ Wax from Plastic Pyrolysis | |
|---|---|
| Gravity (°API) | 35.6 |
| Simulated Distillation, (° F., LV %) | |
| IBP/5 | 591/648 |
| 10/30 | 675/728 |
| 50 | 761 |
| 70/90 | 795/851 |
| 95/EP | 891/1034 |

This feed was isomerized over the same catalyst as the feed in Example A at the same total pressure, LHSV, and $H_2$ rate, but an isomerization catalyst reactor temperature of 610° F. Hydrofinishing was the same as in Example A. Product yields and properties are given in Table 6.

TABLE 6

| Isomerization of Waxy Light Neutral Base Oil Plus 21.3 wt. % Wax from Plastic Pyrolysis at 610° F., 1.0 $h^{-1}$ LHSV, 1935 psig, and 5.70 MSCF/bbl $H_2$ | |
|---|---|
| Conversion <700° F. (wt. %) | 10.21 |
| Yields (wt. %) | |
| $C_1$-$C_2$ | 0.15 |
| $C_3$ | 0.56 |
| $C_4$ | 1.38 |
| $C_5$-180° F. | 2.72 |
| 180-700° F. | 20.87 |
| 700° F.+ | 74.77 |
| Pour point (° C.) | −22 |
| Cloud point (° C.) | +7 |
| Viscosity, 40° C. (cSt) | 19.27 |
| Viscosity, 100° C. (cSt) | 4.163 |
| VI | 120 |

Example 3

To the feed of Example A was added 50 wt. % of a 650° F.+ wax derived from the pyrolysis of a waste polyethylene feedstock. The resulting feed had the inspections shown in Table 7.

TABLE 7

| Blend of Waxy Light Neutral Base Oil and 50 wt. % 650° F.+ Wax from Plastic Pyrolysis | |
|---|---|
| Gravity (°API ) | 36.6 |
| Simulated Distillation, (° F., LV %) | |
| IBP/5 | 594/649 |
| 10/30 | 675/732 |
| 50 | 771 |
| 70/90 | 815/918 |
| 95/EP | 973/1073 |

This feed was isomerized over the same catalyst as the feed in Example A at the same total pressure, LHSV, and $H_2$ rate, but an isomerization catalyst reactor temperature of 622° F. Hydrofinishing was the same as in Example A. Product yields and properties are given in Table 8.

TABLE 8

| Isomerization of Waxy Light Neutral Base Oil Plus 50 wt. % 650° F.+ Wax from Plastic Pyrolysis at 622° F., 1.0 $h^{-1}$ LHSV, 1935 psig, and 5.70 MSCF/bbl $H_2$ | |
|---|---|
| Conversion <700° F. (wt. %) | 15.37 |
| Yields (wt. %) | |
| $C_1$-$C_2$ | 0.19 |
| $C_3$ | 0.70 |
| $C_4$ | 1.80 |
| $C_5$-180° F. | 3.56 |
| 180-700° F. | 23.67 |
| 700° F.+ | 70.58 |
| Pour point (° C.) | −20 |
| Cloud point (° C.) | +16 |
| Viscosity, 40° C. (cSt) | 21.01 |
| Viscosity, 100° C. (cSt) | 4.580 |
| VI | 137 |

Note that while the VI is high, the cloud point (+16° C.) is high as well.

Example 4

The 650° F.+ wax from pyrolysis of polyethylene was distilled at 950° F. to remove the high boiling tail (about 15 wt % of the wax) which was believed to be responsible for the high cloud point in the product oil. This gave a wax with the simulated distillation shown in Table 9.

TABLE 9

| 650-950° F. Wax from Plastic Pyrolysis | |
|---|---|
| Simulated Distillation, (° F., LV %) | |
| IBP/5 | 644/669 |
| 10/30 | 689/755 |
| 50 | 821 |
| 70/90 | 888/971 |
| 95/EP | 1002/1074 |

25 wt. % of this wax was blended into the feed of Example A, with the resulting feed having the inspections shown in Table 10.

TABLE 10

| Blend of Waxy Light Neutral Base Oil and 25 wt. % 650-950° F. Wax from Plastic Pyrolysis | |
|---|---|
| Gravity (°API ) | 34.8 |
| Simulated Distillation, (° F., LV %) | |
| IBP/5 | 603/645 |
| 10/30 | 668/719 |
| 50 | 755 |
| 70/90 | 788/839 |
| 95/EP | 888/1007 |

This feed was isomerized over the same catalyst as the feed in Example A at the same total pressure, LHSV, and $H_2$ rate, but an isomerization catalyst reactor temperature of 619° F. Hydrofinishing was the same as in Example A. Product yields and properties are given in Table 11.

TABLE 11

| Isomerization of Waxy Light Neutral Base Oil Plus 25 wt. % 650-950° F. Wax from Plastic Pyrolysis at 619° F., 1.0 $h^{-1}$ LHSV, 1935 psig, and 5.70 MSCF/bbl $H_2$ | |
|---|---|
| Conversion <700° F. (wt. %) | 12.61 |
| $C_1$-$C_2$ | 0.22 |
| $C_3$ | 0.83 |
| $C_4$ | 2.00 |
| $C_5$-180° F. | 3.32 |
| 180-700° F. | 24.94 |
| 700° F.+ | 69.16 |
| Pour point (° C.) | −19 |
| Cloud point (° C.) | −2 |
| Viscosity, 40° C. (cSt) | 19.18 |
| Viscosity, 100° C. (cSt) | 4.117 |
| VI | 116 |

Note that removing the 950° F.+ cut from the wax led to a lower cloud point than for the similar 115 VI oil of Example 1.

Example 5

35 wt. % of the 650-950° F. wax from Example 4 was blended into the feed of Example A, with the resulting feed having the inspections shown in Table 12.

TABLE 12

| Blend of Waxy Light Neutral Base Oil and 35 wt. % 650-950° F. Wax from Plastic Pyrolysis | |
|---|---|
| Gravity (°API) | 35.3 |
| Simulated Distillation, (° F., LV %) | |
| IBP/5 | 601/653 |
| 10/30 | 674/726 |
| 50 | 764 |
| 70/90 | 800/880 |
| 95/EP | 936/1014 |

This feed was isomerized over the same catalyst as the feed in Example A at the same total pressure, LHSV, and $H_2$ rate, but an isomerization catalyst reactor temperature of 670° F. and 678° F. Hydrofinishing was the same as in Example A. Product yields and properties are given in Table 13.

TABLE 13

| Isomerization of Waxy Light Neutral Base Oil Plus 35 wt. % 650-950° F. Wax from Plastic Pyrolysis at 1.0 $h^{-1}$ LHSV, 1935 psig, and 5.70 MSCF/bbl $H_2$ | | |
|---|---|---|
| Temperature (° F.) | 670 | 678 |
| Conversion <700° F. (wt. %) | 24.18 | 28.36 |
| $C_1$-$C_2$ | 0.42 | 0.48 |
| $C_3$ | 1.66 | 2.08 |
| $C_4$ | 2.87 | 4.72 |
| $C_5$-180° F. | 5.92 | 6.90 |
| 180-700° F. | 27.77 | 27.92 |
| 700° F.+ | 61.96 | 58.59 |
| Pour point (° C.) | −12 | −25 |
| Cloud point (° C.) | +8 | −3 |
| Viscosity, 40° C. (cSt) | 21.59 | 22.02 |
| Viscosity, 100° C. (cSt) | 4.600 | 4.558 |
| VI | 132 | 123 |

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one reference. As used herein, the term "include" and its grammatical variants are intended to be non-limiting, such that recitation of items in a list is not to the exclusion of other like items that can be substituted or added to the listed items.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. To an extent not inconsistent herewith, all citations referred to herein are hereby incorporated by reference.

The invention claimed is:

1. A process for making a lubricating base oil having a viscosity index of at least 110, comprising the steps of:

a) combining a waxy light neutral base oil and a wax derived from pyrolyzing a plastics feed comprising polyethylene to form a blend;

b) hydroisomerization dewaxing the blend; and c) recovering the lubricating base oil from an effluent from the hydroisomerization dewaxing step.

2. The process of claim 1, wherein the plastics feed comprises at least 95 wt. % polyethylene.

3. The process of claim 1, wherein the polyethylene is selected from the group consisting of waste polyethylene, virgin polyethylene, and mixtures thereof.

4. The process of claim 1, wherein the polyethylene is selected from the group consisting of high-density polyethylene, low-density polyethylene, and mixtures thereof.

5. The process of claim 1, wherein less than 10 wt. % of the wax derived from pyrolyzing a plastics feed boils above 1000° F. (538° C.).

6. The process of claim 1, wherein less than 5 wt. % of the wax derived from pyrolyzing a plastics feed boils above 1000° F. (538° C.).

7. The process of claim 1, wherein the blend comprises at least 20 wt. % of the wax derived from pyrolyzing a plastics feed.

8. The process of claim 1, wherein the blend comprises at least 50 wt. % of the wax derived from pyrolyzing a plastics feed.

9. The process of claim 1, wherein the hydroisomerization dewaxing is performed using a shape selective intermediate pore size molecular sieve.

10. The process of claim 9, wherein the molecular sieve is selected from the group consisting of SAPO-11, SAPO-31, SAPO-41, SM-3, SM-7, ZSM-22, ZSM-23, ZSM-35, ZSM-48, ZSM-57, SSZ-32, SSZ-32X, metal modified SSZ-32x, offretite, ferrierite, and combinations thereof.

11. The process of claim 1, wherein the lubricating base oil is a Group II plus base oil.

12. The process of claim 1, wherein the lubricating base oil is a Group III base oil.

13. The process of claim 1, wherein the lubricating base oil has a viscosity index of at least 130.

14. The process of claim 1, wherein the lubricating base oil has a viscosity index of at least 140.

15. The process of claim 1, wherein the lubricating base oil has a pour point of less than −10° C.

16. The process of claim 1, wherein the lubricating base oil has a pour point of less than −20° C.

17. The process of claim 1, wherein the lubricating base oil has a cloud point of less than 0° C.

* * * * *